US005588341A

United States Patent [19]

Higuchi

[11] Patent Number: 5,588,341

[45] Date of Patent: Dec. 31, 1996

[54] FUSE EXTRACTION TOOL

[75] Inventor: Eijii Higuchi, Yokkaichi, Japan

[73] Assignee: Sumitomo Wiring Systems, Ltd., Japan

[21] Appl. No.: 494,826

[22] Filed: Jun. 26, 1995

[30] Foreign Application Priority Data

Jun. 30, 1994 [JP] Japan ..... 6-149096

[51] Int. Cl.[6] ..... B25B 27/14

[52] U.S. Cl. ..... 81/3.8; 29/278; 294/99.1

[58] Field of Search ..... 81/3.8; 29/278, 29/739, 758, 764; 294/99.1, 99.2

[56] References Cited

U.S. PATENT DOCUMENTS 4,226,459 10/1980 Natalicio .
5,267,493 12/1993 Yamagata et al. .

FOREIGN PATENT DOCUMENTS 5-84004 11/1993 Japan .

*Primary Examiner*—James G. Smith
*Attorney, Agent, or Firm*—Banner & Witcoff, Ltd.

[57] ABSTRACT

A tool for removing a blade type fuse comprises a pair of facing forks 12, divided into two from their inner ends to respectively form first and second pairs of legs 14 respectively joined by linking portions 15*a*, 15*b* which are capable of moving together and apart. A separating section 18 is provided projecting from the first linking portion 15*a*, which can be urged between flanges 16 to separate the forks 12.

The tool permits the forks 12 to be gripped for removal of the fuse, but by gripping the linking portions 15*a*, 15*b* the forks will separate to permit the fuse to be removed from the tool.

14 Claims, 3 Drawing Sheets

FUSE EXTRACTION TOOL

TECHNICAL FIELD

The present invention relates to a fuse extraction tool, particularly a tool for extraction of blade type automotive fuses.

BACKGROUND OF THE INVENTION

In the past fuse extraction tools, such as those shown for example in FIG. 4 and FIG. 5 of the accompanying drawings have been used to extract fuses inserted into a fuse holder such as a fuse box, the fuses generally having the shapes shown in FIG. 6 and FIG. 7 of the accompanying drawings.

The fuse-extraction tool 1 shown in FIG. 4 is constructed in such a way that resilient arms 3 connected by a arcuate section 2 at their inner ends are deformed outwardly by pushing their teeth 1*a* into contact with either side of the fuse 4 (FIG. 6*a*), the teeth 1*a* grasping the fuse 4 as the arms recover their shape and engage an undercut thereof.

The fuse extraction tool 5 shown in FIG. 5 is constructed in such a way that a pair of arms 6 are connected in the middle, and the teeth 5*a* at their forward ends can be moved apart by pinching the rear ends. In this way the teeth can be positioned on either side of the edge flange 4*a* of a fuse 4, and then engaged by relaxing the pinching force thereby gripping the fuse 4 for extraction. The rearmost ends are pinched again to remove the fuse from the tool.

However, with the first kind of fuse extraction tool 1, the fuse is held by the resilient deformation of the arms 3 and it is therefore difficult to remove the fuse 4 from the tool 1 after the said fuse 4 has been extracted from its holder, no means for urging the arms apart being provided.

A disadvantage of the first kind of tool 1 is that the blade fuse of FIG. 6 may accidentally slip sideways out of the tool as it is being inserted or removed; the fuse may thus fall into an inaccessible location, for example within the vehicle dashboard.

To overcome this problem, the miniature fuse 7 shown in FIG. 7*a* has a structure whereby the teeth 1*a* engage a groove in order to also prevent the fuse from falling to the side, but this further complicates the operation of removing the fuse from the tool since no means of spreading the arms 3 is provided. The miniature fuse 7 is shown somewhat enlarged in relation to the conventional blade fuse 4.

In the case of the second kind of fuse extraction tool 5, there is a risk that the fuse 4 will fall out as the space between the teeth 5*a* opens up in the operation of extracting the fuse 4. This depends on the level of force applied, but is a consequence of the teeth being separated by inadvertently pinching the rearmost ends of the arms. The fuse may also slip out sideways by accident.

The groove 8 of the miniature fuse 7 shown in FIG. 7*a* are also rather shallow and therefore there have been problems during extraction in that the force to disengage the tool is not high, and consequently removal of the fuse from the fuse holder is rather difficult.

The present invention has taken the above-mentioned problems into account and aims to provide a fuse extraction tool which, regardless of the kind of blade type fuse, is capable of reliably extracting the fuse from the fuse holder, and is able to release the fuse easily after extraction. The tool of the present invention is also especially suitable for use with the miniature fuse shown in FIG. 7 which has the edge flange 4*a* of FIG. 6 removed in order to increase packing density, the groove 8 being provided in a non-critical area.

SUMMARY OF THE INVENTION

According to the invention there is provided a fuse extraction tool having opposed resilient forks linked together at one end, the free ends of the forks having opposed teeth for engagement with a blade type fuse, wherein said forks are divided from said one end in the direction of said free ends so as to form legs of each fork, opposite legs of each fork being connected by respective link members, and the legs connected by respective link members being movable towards and away from each other, one of said link members having a projection engageable to urge legs connected to other link member apart such that in use when the link members are urged together in a direction substantially perpendicular to the plane of said forks, the free ends of said forks are urged apart.

Such a tool can be forcefully gripped to pull the fuse from its holder whilst not exerting any releasing forces on the forks. However, by gripping the tool at right angles and squeezing, the forks can be urged apart to release the fuse.

Preferably the forks are parallel and in a preferred embodiment the link members are parallel. The legs of each fork may diverge at said one end. The mouth of the tool may be tapered to facilitate smooth engagement of a fuse.

Preferably said projection has a triangular section whose apex faces the forks of said other link member, and the legs of said other link member have opposed flanges with a predetermined spacing, the projection being movable between and against said flanges to urge apart the legs connected to said other link member.

BRIEF DESCRIPTION OF THE DRAWINGS

Other aspects of the invention will be apparent from the following description of a preferred embodiment shown by way of example only with reference to the accompanying drawings in which.

DESCRIPTION OF THE PREFERRED EMBODIMENT

Figure 2:
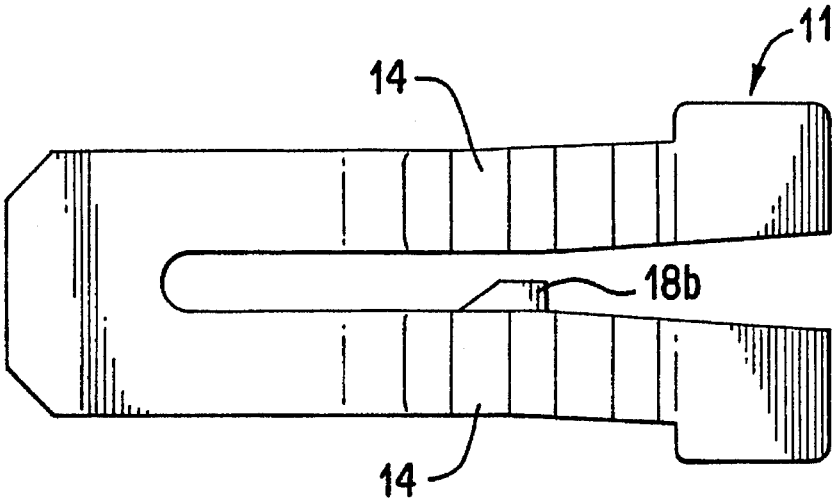
FIG. 2 is a side elevation of the tool of FIG. 1.
Figure 3:
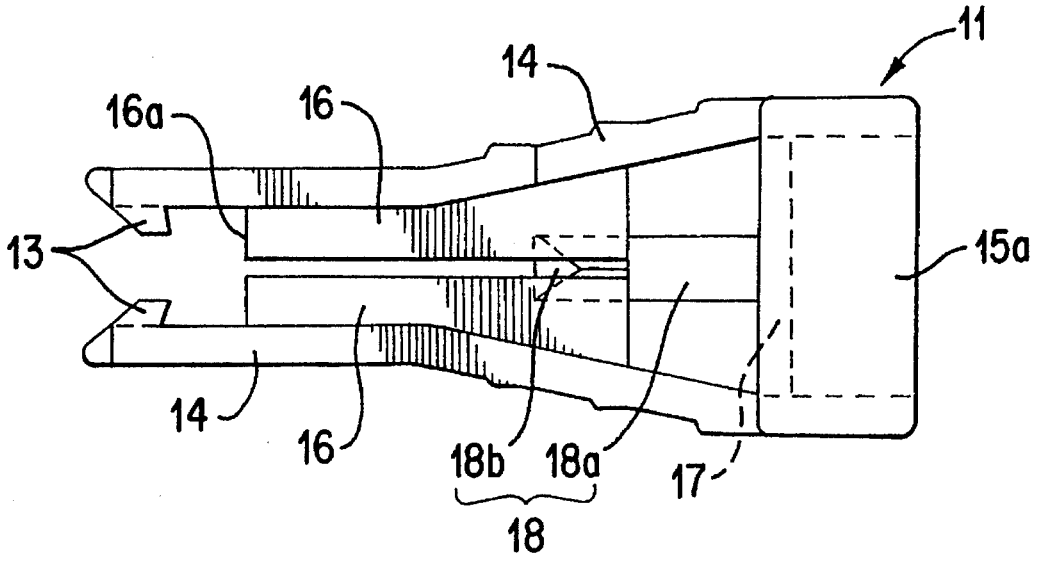
FIG. 3 is a plan view of the tool of FIG. 1.
Figure 4:
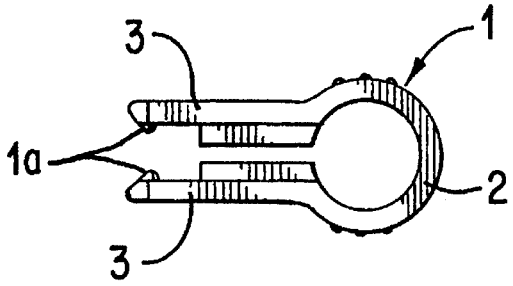
FIG. 4 PRIOR ART
FIG. 4 is a plan view of a prior art fuse extraction tool.
Figure 5:
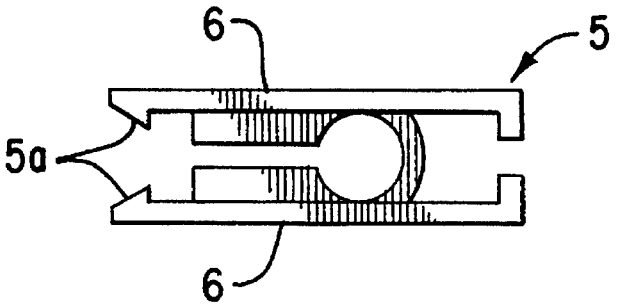
FIG. 5 PRIOR ART
FIG. 5 is a plan view of another prior art fuse extraction tool.
Figure 6A:
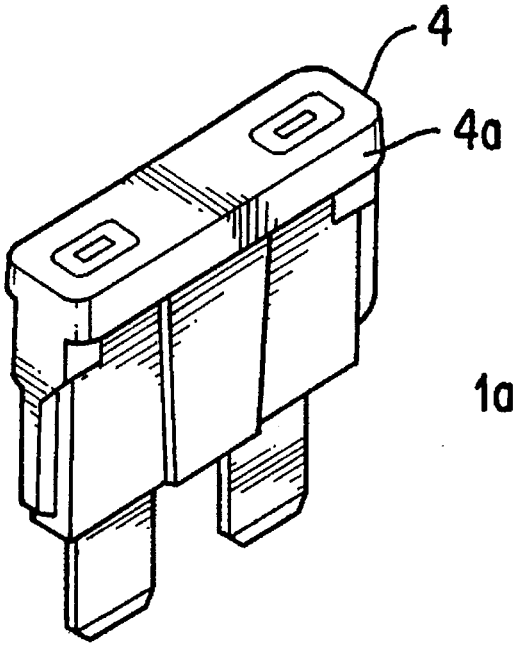
FIG. 6*a* is an oblique view of a blade type automotive fuse.
Figure 6B:
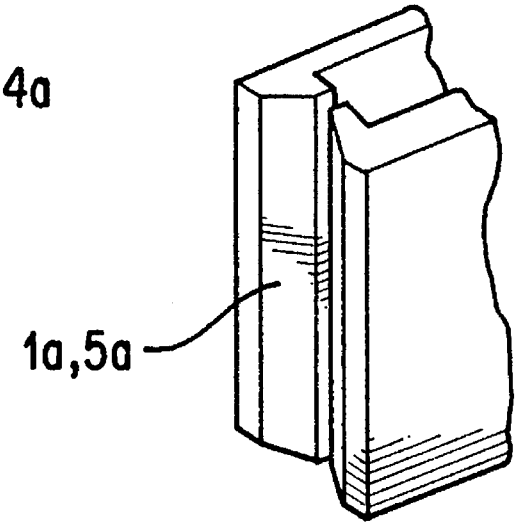
FIG. 6*b* is an oblique view illustrating the teeth of a fuse extraction tool for the fuse of FIG. 6*a;*
Figure 7A:
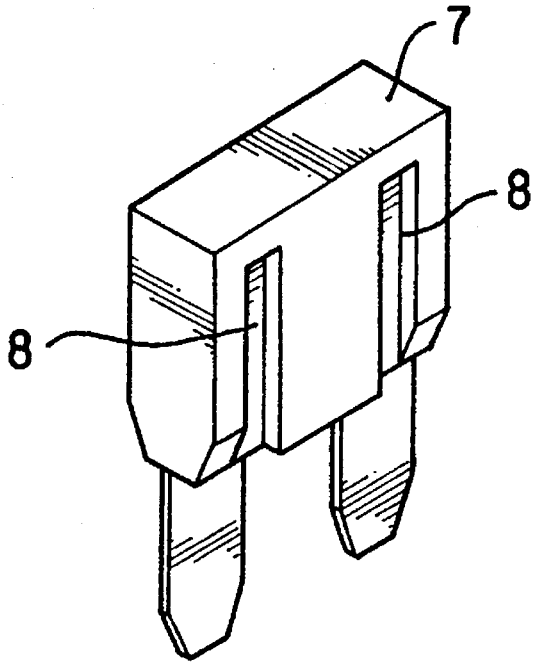
FIG. 7*a* is an oblique view showing the shape of another blade type fuse.
Figure 7B:
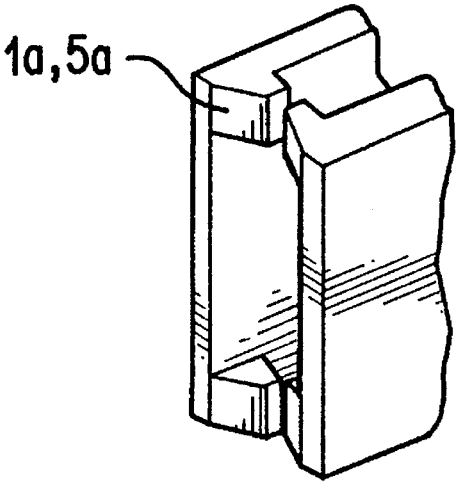
FIG. 7*b* is an oblique view illustrating the teeth of a fuse extraction tool for the fuse of FIG. 7*a.*

An embodiment of the present invention is described below with particular reference to FIGS. 1–3.

Figure 1:
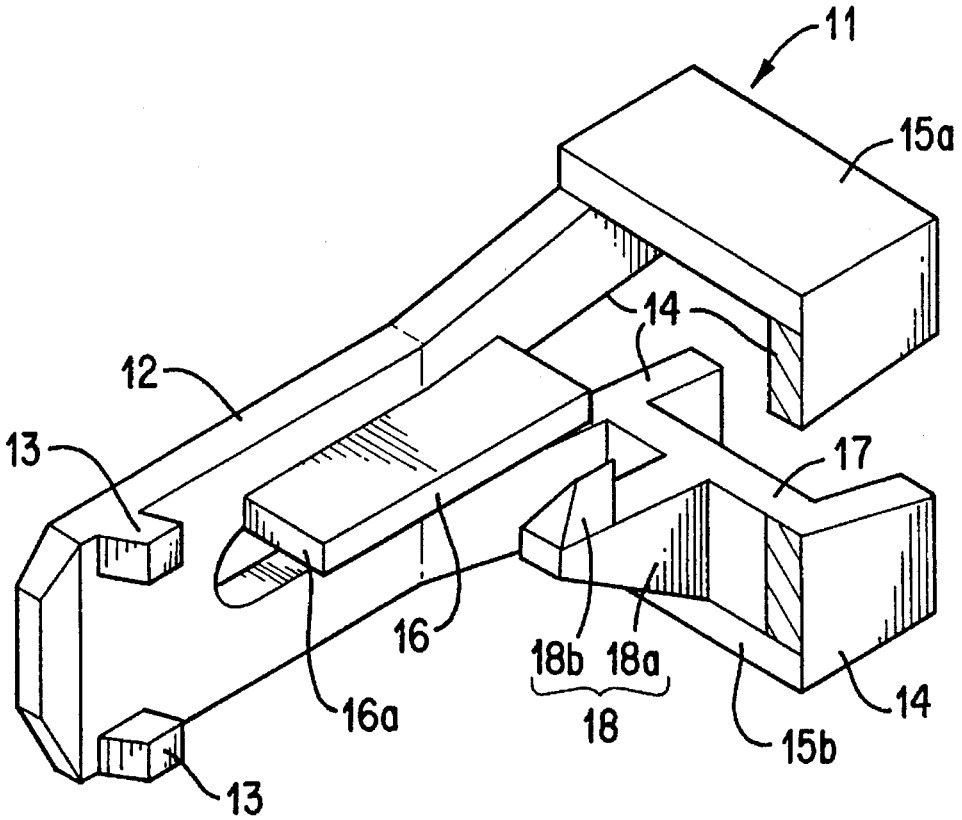
FIG. 1 is a partially cut-away oblique view of a fuse extraction tool according to the present invention.

FIG. 1 is a partially cut-away oblique view of a fuse extraction tool 11 formed as a synthetic resin moulding. This fuse extraction tool 11 has a pair of forks 12 linked at one end as shown. The forks 12 have opposed teeth 13 projecting inwardly at the outer ends thereof; two teeth are provided on each fork 12, one each adjacent the lateral edge of the respective fork. The extreme ends of the two forks 12 are chamfered and the facing surfaces taper so as to slightly widen the mouth of the tool. One of the forks 12 is removed in FIG. 1 so as to clearly show other parts of the tool.

The inner ends of the above-mentioned forks 12 are divided into two in the longitudinal direction to respectively form a pair of legs 14. The legs 14 are respectively linked by a first linking section 15*a* and a second linking section 15*b* which extend between the forks 12. If the first linking section 15*a* and the second linking section 15*b* are pinched toward each other, the paired legs 14 of each fork resiliently deform so as to approach each other.

Opposite tabular flanges 16 are provided on the inside of the legs 14 which are linked by the first link section 15*a*. The flanges 16 extend longitudinally of the legs and define predetermined gap between the facing edges thereof. The flanges 16 can be pushed apart when the projection 18*b*, discussed hereinbelow, is forced between them. The arrangement in such that the outer end surface of a fuse 7 will come into contact with the outer end 16*a* of the flanges 16 when the teeth 13 grip the grooves 8 of a fuse 7 in use.

A support plate 17 is integrally formed in the recess formed by the above-mentioned second linking section 15*b* and the legs 14 connected thereto, and a separating section 18 is provided extending from the centre of the support plate 17 toward the outer ends of the forks 12. The separating section 18 comprises a base 18*a* with a cross-section in the form of a right-angled triangle, and a projection 18*b* projecting upwardly and inwardly from the outer edge of the base 18*a*. The projection 18*b* has a triangular section as illustrated and it is arranged in such a way that it can be forced into the gap between the two tabular flanges 16 so as to enlarge the space therebetween, and thereby force the forks apart.

With a fuse extraction tool 11 of the configuration described above, the extraction of a fuse 7 from a fuse holder is carried out as follows.

Orthogonal portions of the first linking section 15*a* and the second linking section 15*b* are held between finger and thumb and the fuse extraction tool 11 is pushed in against a fuse 7. Because the outer ends of the tool 11 are chamfered (FIG. 3) the tool is positioned smoothly against the two side surfaces of the fuse 7, and the forks 12 are resiliently deformed outwards as the teeth 13 engage the fuse. The forks 12 then recover their shape when the teeth 13 engage the grooves 8 of the fuse 7, and the front ends 16*a* of the tabular flanges 16 come into contact with the outer edge of the fuse 7; the hold on the fuse 7 is thus secure.

When a fuse 7 is engaged by the tool 11 in this way, it can be extracted from the fuse holder by pulling. The fuse 7 is released from the tool 11 by using the fingers to pinch and apply a force to the first linking section 15*a* and the second linking section 15*b*. In this releasing operation, the projection 18*b* of the separating section 18 is urged between the tabular flanges 16, and thereby resiliently deform the legs 14. By pressing the sloping surfaces of the projection 18*b* against the side edges of the flanges 16, the gap is gradually enlarged. Thus, because the forks 12 are resiliently deformed sideways, the space between the teeth 13 is opened up, and the fuse 7 can be released.

When extracting a fuse 7 from the fuse holder using the extraction tool 11 in this way, the gripped state between the teeth 13 and the fuse 7 is obtained by using resilient deformation of the forks 12. The position for pinching with the fingers is one orthogonal to the first linking section 15*a* and the second linking section 15*b*. Thus, even if, for example, a strong gripping force is exerted when removing the fuse, the spacing between the teeth 13 does not increase, and there is no likelihood that the fuse 7 will fall out during the extraction operation or that the tool will disengage the fuse.

As will be clear from the above description, a firm grip can be ensured by the present invention because the teeth grip the fuse with only the action of the resilient force of the forks, and yet the fuse can be easily removed by squeezing the tool substantially at right angles.

I claim:

1. A fuse extraction tool comprising an end portion having opposed resilient forks extending therefrom, said forks having free ends, and said free ends having opposed teeth for engagement with a blade type fuse, wherein said forks are divided from said end portion in the direction of said free ends so as to form two legs of each fork, the legs lying in a plane perpendicular to the plane of the forks, opposite legs of each fork being connected by respective link members which constitute said end portion, and the legs connected by respective link members being movable towards and away from each other, one of said link members having a projection to urge legs connected to the other link member apart such that in use when the link members are urged together in a direction substantially perpendicular to the plane of said forks, the free ends of said forks are urged apart.

2. A tool according to claim 1 wherein said forks are parallel.

3. A tool according to claim 1 wherein said link members are parallel.

4. A tool according to claim 2 wherein said link members are parallel.

5. A tool according to claim 1 wherein the legs of each fork have inner faces which diverge at said end portion.

6. A tool according to claim 1 wherein the free ends of said forks have chamfered inner faces to define a tapered mouth portion.

7. A tool according to claim 2 wherein the free ends of said forks have chamfered inner faces to define a tapered mouth portion.

8. A tool according to claim 1 wherein said teeth are disposed inwardly of said free ends.

9. A tool according to claim 7 wherein said teeth are disposed inwardly of said chamfered inner faces.

10. A tool according to claim 1 wherein two teeth are provided on each fork.

11. A tool according to claim 1 wherein said projection is triangular in section, an apex of the projection facing the forks of said other link member, the legs of said other link member having opposed flanges with a predetermined spacing, and the projection being movable between and against said flanges to urge apart the legs connected to said other link member.

12. A tool according to claim 11 wherein said flanges are perpendicular to a respective leg and lie in the same plane.

13. A tool according to claim 12 wherein said flanges are spaced from the respective link member in the direction of said free ends.

14. A tool according to claim 11 wherein said flanges are identical, are inwardly spaced from said teeth, and define at their ends adjacent said teeth an abutment for the fuse in use.

* * * * *